US005570784A

United States Patent [19]

Sidabras et al.

[11] Patent Number: 5,570,784

[45] Date of Patent: Nov. 5, 1996

[54] TOOL ORGANIZER AND DEPLOYMENT APPARATUS

[75] Inventors: Romie K. Sidabras, Riverside; Jeffrey E. Bennett, Newhall, both of Calif.

[73] Assignee: Allied Wholesale, Inc., Sylmar, Calif.

[21] Appl. No.: 524,473

[22] Filed: Sep. 7, 1995

Related U.S. Application Data

[63] Continuation of Ser. No. 996,770, Dec. 24, 1992, abandoned.

[51] Int. Cl.[6] ..... B65D 85/20

[52] U.S. Cl. ..... 206/378; 206/379; 206/759

[58] Field of Search ..... 206/425, 376, 206/378, 379, 372, 373, 45.15, 477, 478, 483; 211/70.6, 170, 69, 164

[56] References Cited

U.S. PATENT DOCUMENTS

| | | | |
|---|---|---|---|
| 979,981 | 12/1910 | Milke | 211/69 X |
| 1,342,364 | 6/1920 | Wikstrom | 211/69 |
| 2,228,493 | 1/1941 | Will | 206/564 X |
| 2,408,227 | 9/1946 | Ramsey | 211/69 X |
| 2,736,426 | 2/1956 | Hamilton | 211/69 X |
| 2,775,342 | 12/1956 | Smith | 206/379 |
| 2,792,935 | 5/1957 | Rocchetti | 206/379 |
| 3,074,539 | 1/1963 | Rogovin | 206/379 |
| 3,337,028 | 8/1967 | Glavan | 211/69 X |
| 3,583,556 | 6/1971 | Wagner | 211/69 X |
| 3,726,393 | 4/1973 | Thompson | 211/70.6 X |
| 3,870,149 | 3/1975 | Huot | 206/379 |
| 4,212,401 | 7/1980 | Schweizer | 211/170 X |
| 4,337,860 | 7/1982 | Carrigan | 206/378 X |
| 4,624,375 | 11/1986 | Strongosky | 211/170 |
| 4,660,719 | 4/1987 | Peterson et al. | 206/379 |
| 4,684,019 | 8/1987 | Egly | 206/425 X |
| 4,951,812 | 8/1990 | Chen | 206/373 X |
| 4,955,478 | 9/1990 | Rau et al. | 206/372 X |
| 5,050,733 | 9/1991 | Brennan | 206/376 X |
| 5,222,610 | 6/1993 | Johansen et al. | 211/170 X |
| 5,368,164 | 11/1994 | Bennett et al. | 206/373 |

FOREIGN PATENT DOCUMENTS

| | | | |
|---|---|---|---|
| 0424927 | 5/1991 | European Pat. Off. | 211/70.6 |
| 4006782 | 9/1991 | Germany | 211/70.6 |
| 60-175588 | of 1985 | Japan . | |
| 2124191 | 2/1984 | United Kingdom | 206/372 |

OTHER PUBLICATIONS

Photographs illustrating a six peice HSS metal drill bit set having a rotatable drill bit storage apparatus. admitted Prior Art, see p. 14.

Pp. 6, 8, and 9 of a Huot Catalog Illustrating drill bit indexes which are rotatable within a container. Admitted Prior Art, see p. 14.

Hamberger et al., IBM Technical Disclosure Bulletin, Jan. 1978, vol. 20, No. 8, 2987–2988.

Six pages illustrating drill cases and drill sets which are purportedly from a German company's catalog dating from 1990. (Werkzeuge).

*Primary Examiner*—Ted Kavanaugh

*Attorney, Agent, or Firm*—Lyon & Lyon

[57] ABSTRACT

A tool organizer and deployment apparatus for various tools and accessories for tools. Rotatable flip indexes secure drill bits, power bits, sockets or other tool accessories and are conveniently stored in a tray and lid combination having a housing surface that removably secures the flip indexes. The housing also separately supports individual tools. The specific accessory, flip index or tool required may be grasped and removed from the tray for a specific task. The apparatus also utilizes a clear plastic cover to accommodate the display of the tools.

18 Claims, 2 Drawing Sheets

TOOL ORGANIZER AND DEPLOYMENT APPARATUS

This is a continuation of application(s) Ser. No. 07/996,770 filed on Dec. 24, 1992 now abandoned.

The field of the invention is storage devices for hand or power tool implements. In almost every home or factory, many sizes of tools and their accessories are needed for different jobs. Therefore, to try to organize and store these tools and accessories, a conventional tool case is generally used to store different kinds and sizes of tools and accessories.

One conventional tool storage case has several layers of rotating "boxes" laying one on top of the other. These rotating boxes are stacked one on top of the other in a bottom closure making it difficult to get a tool in the middle layers because of inconvenient stacking and the limited space around each layer. Conventional tool storage boxes are usually made of metal and as a result, it takes more time to assemble them, they are more expensive and they are not easy to carry. User convenience was apparently overlooked in these conventional cases.

This invention is an improvement to the conventional tool storage devices and includes a convenient tool deployment feature. A feature of the present invention includes rotatable indexes for easy access to the tools. A separate tool support is also provided. The invention comprises a bottom tray and a lid integrally but rotatably, attached to the tray. Inside the tray there are several different sized compartments. A feature of the present invention is the flip index and its ability to rotate while secured to a compartment. The flip index is secured in a compartment of the bottom tray, each compartment sized to accommodate a flip index storing different tool accessories. The flip index is seated to the bottom tray through a hinge device and may be rotated up from the tray surface, thus forming an angle to the tray. This makes it easy to take out the particular tool item.

Accordingly it is an object of the present invention to provide a tool organizer and deployment apparatus, but other and more detailed objects and advantages will appear to those skilled in the art from the following description and the accompanying drawings, wherein.

Figure 1:
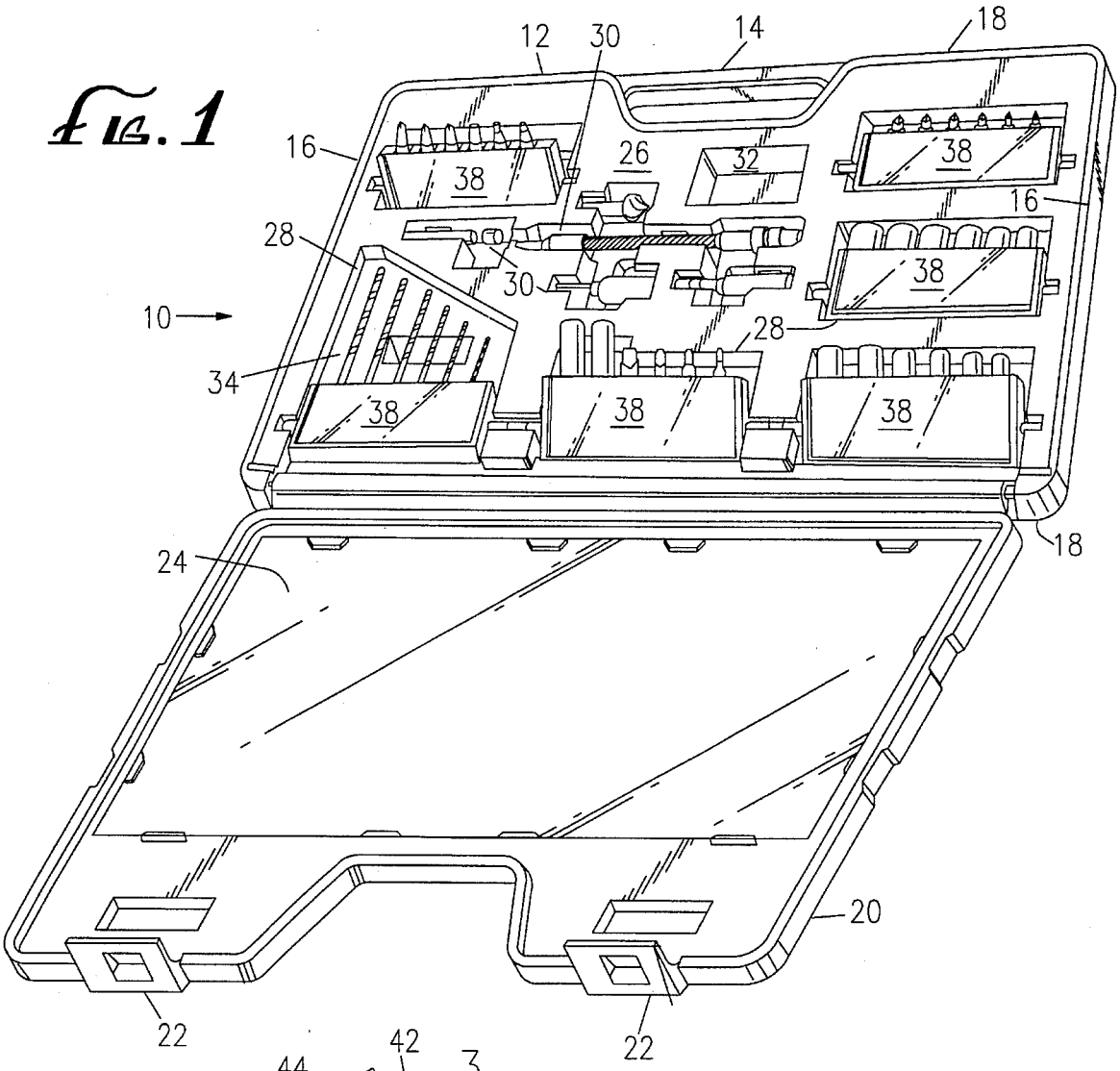
FIG. 1 illustrates the present invention and the positioning of the flip indexes on the surface of the tray.

Turning now to the figures, FIG. 1 illustrates the organizer and deployment apparatus 10. A generally rectangular tray 12 has a handle 14 and is made up of sidewalls 16 and endwalls 18. Attached to the tray 12 is the lid 20 which has latches 22 which are used to secure the lid 20 to the tray 12. One feature of this embodiment includes a transparent surface 24 secured to the lid 20. Attached to the tray 12 is the housing surface 26 spanning between the sidewalls 16 and between the endwalls 18. In this embodiment, the housing surface 26 is made of a molded plastic material. Preferably, the tray 12 and the lid 20 are made of plastic also.

As shown in FIG. 1, the housing surface 26 has a series of recessed openings or compartments 28 thereon. The housing 26 also has individual tool supports 30 and a storage area 32 as shown in FIG. 1. The compartments 28 have a central support section 34 which is shaped to allow for the convenient use and deployment of various tool accessories.

Receptacles 36 are positioned on opposing sides of the compartments 28 to rotatably secure removable flip indexes 38 at the central support section 34. The size of the compartments 28 allow the flip indexes 38 to be grasped while they are attached to the surface 26 and separately handled.

Figure 2:
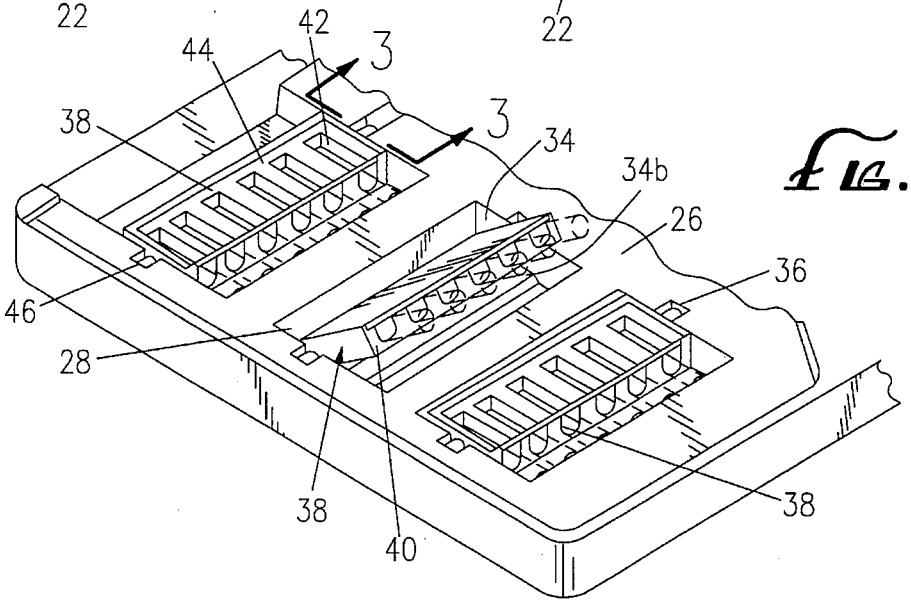
FIG. 2 is a cut-away view illustrating the pivoting action of the flip index.

Referring to FIG. 2, in one feature, the flip indexes 38 are comprised of a body 40 having numerous storage cells 42 for the discrete storage of individual drill bits, power bits or other tool accessories as shown in FIG. 1. A front retainer 44 is secured to the body 40 adjacent to the storage cells 42. The front retainer 44 may be made of a transparent material. In one feature, the front retainer 44 is a clear plastic panel bearing indicia indicating specific sizes of the individual tool accessories stored therein.

Studs 46 secure the flip index 38 to the respective receptacles 36 as shown in FIG. 2 to allow the flip index 38 to be rotated by finger pressure while the flip index 38 is attached to the compartment 28. This allows individual flip indexes 38 to also be removed from the tray 12 and used as a portable organizer for the specific tool item he or she needs should the user not want to take the entire apparatus 10 to a specific task. As shown in FIG. 2 and again in FIG. 5, the central support section 34 includes a depressed portion **34*a* and a plateau portion 34*b* to accommodate the specific flip index 38**.

Figure 3:
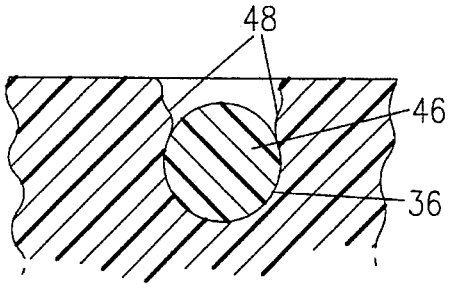
FIG. 3 is a side section view taken along line 3—3 of FIG. 2 illustrating the pivot control means feature.
Figure 4:
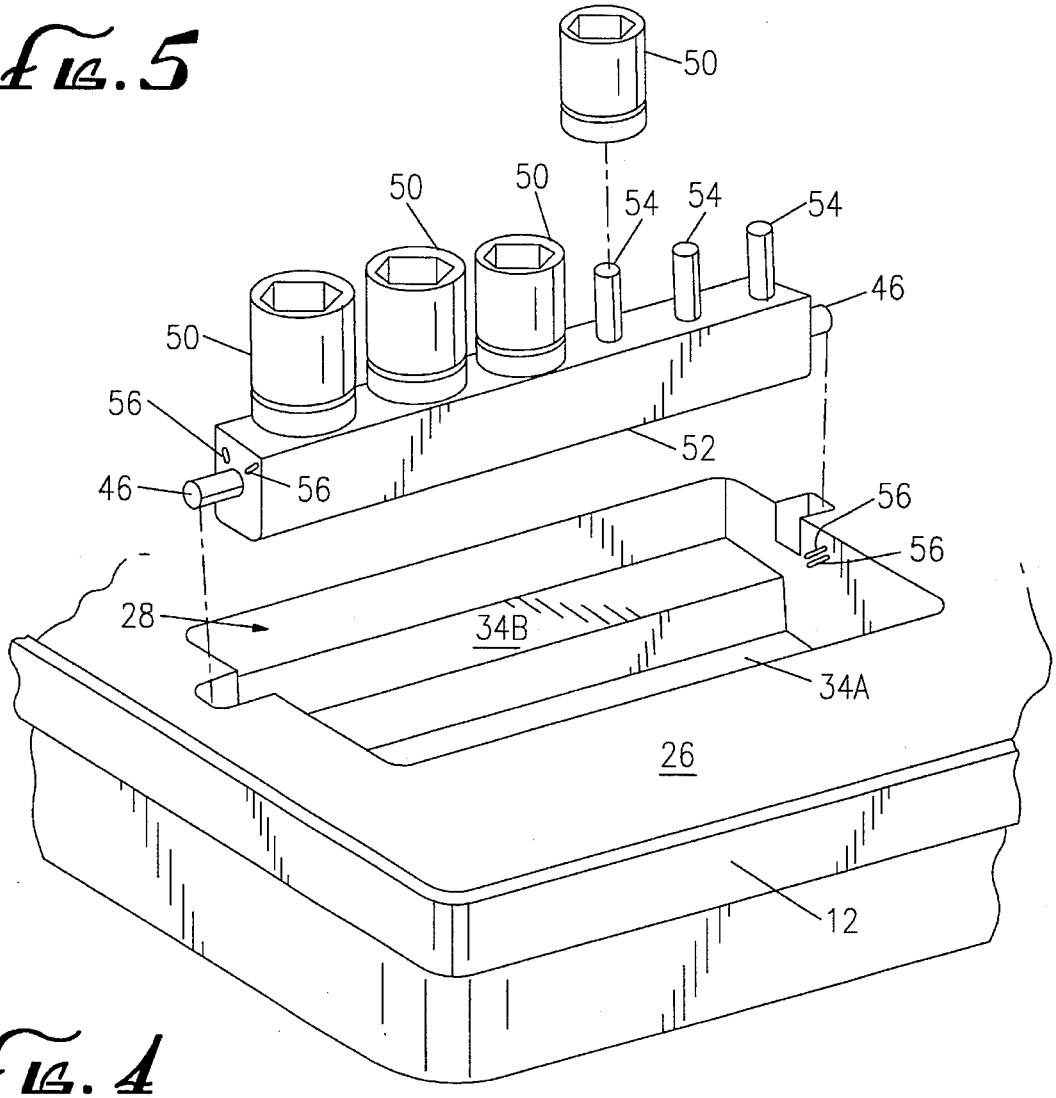
FIG. 4 is an exploded perspective view showing the socket feature of the flip index and the pivoting feature using the ratchet detents.

Referring now to FIG. 3, the stud 46 is shown in its position in the receptacle 36. In addition, first detents 48 secure the stud 46 but still allow finger pressure to rotate the flip index 38 and to also remove the flip index 38 from the receptacle 36. Another feature is shown in FIG. 4 where a flip index 38 may alternately secure sockets 50. As shown in FIG. 4, one flip index is made up of a base 52 and a plurality of socket rods 54 that removably secure the sockets 50 to the base 52. Ratcheting detents 56 are secured to the compartment 28 so that ratcheting detents 56 on the base 52 or body 40 of the flip indexes 38 mesh together to secure the flip index 38 at one or more positions.

Figure 5:
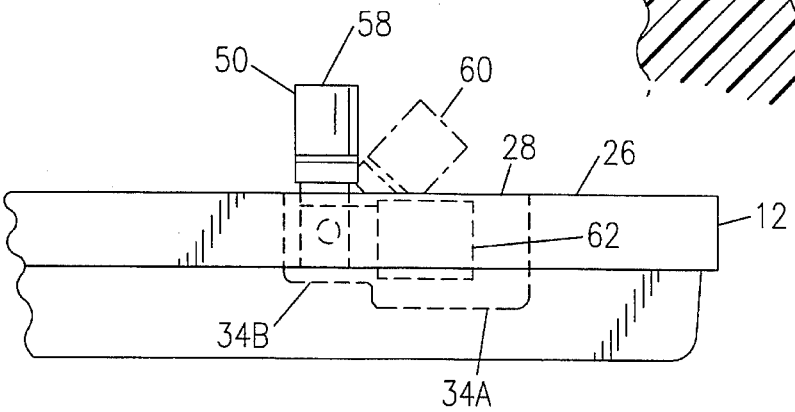
FIG. 5 is a side elevation view showing the pivoting feature of the flip index and its positions in the tray.

As shown in FIG. 5, the detents 56 may secure the flip index 38 at a ninety degree angle position 58, a forty-five degree angle position 60 or a fully down position 62 within the compartment 28 and its central support section 34. Of course, other angular orientations are possible and are included within the scope of this invention.

While the preferred embodiment of the present invention and modifications thereto have been shown and disclosed in the drawings and specification, alternate embodiments of the present invention may be apparent to the person of ordinary skill in the art and this application is intended to include those embodiments within the full breadth and scope of the claims. Moreover, the present invention need not include all of the features disclosed in the single embodiment but rather one or more features may be included.

What is claimed is:

1. A tool organizer and deployment apparatus comprising:

a lid;

a tray, rotatably secured to said lid;

a molded plastic housing surface attached to said tray comprising a multiplicity of compartments;

a plurality of flip indexes releasably securing tool accessories, each of said flip indexes releasably secured at one of said compartments;

pivot control means molded into each of said multiplicity of compartments for releasably controlling the pivot of said flip indexes and adapted to permit said flip indexes to be removed, said pivot control means comprising two receptacles on opposing sides of each of said multiplicity of compartments, each receptacle having a mouth opening to said housing surface and first detents located in said mouth; and contact means attached to each of said flip indexes for releasably engaging said pivot control means, said contact means comprising a pair of studs on opposing sides of said flip index.

2. The apparatus of claim 1 where said pivot control means and said contact means comprise ratcheting detents.

3. The apparatus of claim 2 where said flip indexes may be rotatably positioned at an angle selected from the group consisting of approximately ninety degrees and approximately forty-five degrees from said housing surface while said flip indexes are secured at said compartments.

4. The apparatus of claim 1 where at least one of said flip indexes comprises a base and a plurality of socket rods for releasably positioning sockets on said base.

5. The apparatus of claim 1 where at least one of said flip indexes comprises a storage body and a front retainer secured to said body, said storage body comprising a plurality of storage cells.

6. The apparatus of claim 5 where said storage cells releasably accommodate the storage of drill bits.

7. The apparatus of claim 5 where said storage cells releasably accommodate the storage of power bits.

8. The apparatus of claim 1 where said housing surface comprises a plurality of tool supports.

9. The apparatus of claim 1 where said lid comprises at least one latch and said tray comprises latch attachment means for securing said lid to said tray.

10. The apparatus of claim 1 where said lid further comprises a transparent surface.

11. A tool organizer and deployment apparatus comprising:

a tray comprising a first sidewall, a second sidewall spaced apart from the first sidewall, a first end wall, a second end wall spaced apart from the first end wall, the first and second end walls joining the first and second sidewalls, and a molded plastic housing surface secured within said sidewalls and said end walls, said housing surface comprising tool supports and a plurality of individual recessed openings extending laterally on said housing surface, each of said recessed openings having at least one receptacle, each of said at least one receptacle having a mouth opening to said housing surface and first detents located in said mouth;

a lid, rotatably secured to at least one of said sidewalls; and a plurality of flip indexes releasably securing tool accessories, each of said flip indexes corresponding to one of said recessed openings and each of said flip indexes having contact means for releasably engaging with said at least one receptacle, wherein (i) said contact means releasably engage with said at least one receptacle by snapping into said at least one receptacle under finger pressure, and (ii) said first detents secure said contact means within said at least one receptacle, but still allow finger pressure to rotate said flip index and to remove said flip index from said receptacle.

12. The apparatus of claim 11 where said tray comprises a carrying handle.

13. A tool organizer and deployment apparatus comprising:

a lid;

a tray, rotatably secured to said lid;

a molded plastic housing surface attached to said tray comprising at least one compartment thereon, said at least one compartment having a central support section and at least one receptacle molded therein, each of said at least one receptacle having a mouth opening to said housing surface and first detents in said mouth;

at least one flip index releasably securing tool accessories, said at least one flip index releasably secured at said at least one compartment, said at least one flip index comprising at least one member projecting from at least one side of said at least one flip index for releasably engaging said at least one receptacle and said first detents.

14. The apparatus of claim 13 wherein:

said at least one flip index further comprises ratcheting detents on at least one side; and said compartment further comprises ratcheting detents that mesh with said ratcheting detents on said at least one flip index.

15. The apparatus of claim 13 wherein said at least one flip index may be rotatably positioned at any given angle between approximately ninety degrees and approximately zero degrees from said housing surface while said at least one flip index is secured at said at least one compartment.

16. A tool organizer and deployment apparatus comprising:

a molded plastic housing surface attached to said tray comprising at least one compartment thereon, said at least one compartment having a central support section and at least one receptacle molded therein, each of said at least one receptacle having a mouth opening to said housing surface and first detents located in said mouth;

at least one flip index releasably securing tool accessories, said at least one flip index releasably secured at said at least one compartment, and said at least one flip index comprising at least one member projecting from at least one side of said at least one flip index for releasably engaging said at least one receptacle and said first detents.

17. The apparatus of claim 16 wherein:

said at least one flip index further comprises ratcheting detents on at least one side; and said compartment further comprises ratcheting detents that mesh with said ratcheting detents on said at least one flip index.

18. The apparatus of claim 16 wherein said at least one flip index may be rotatably positioned at any selected angle between approximately ninety degrees and approximately zero degrees from said housing surface while said at least one flip index is secured at said at least one compartment.

* * * * *

UNITED STATES PATENT AND TRADEMARK OFFICE

CERTIFICATE OF CORRECTION

PATENT NO. : 5,570,784

DATED : November 5, 1996

INVENTOR(S) : Romie K. Sidabras and Jeffrey E. Bennett

It is certified that error appears in the above-indentified patent and that said Letters Patent is hereby corrected as shown below:

Column 4, line 35 insert:

"a tray;" as a separate paragraph before the paragraph beginning "a molded plastic housing . . .".

Signed and Sealed this

Second Day of December, 1997

*Attest:*

*Attesting Officer*

Bruce Lehman

BRUCE LEHMAN

*Commissioner of Patents and Trademarks*